US011850724B2

(12) United States Patent
Verhagen et al.

(10) Patent No.: US 11,850,724 B2
(45) Date of Patent: Dec. 26, 2023

(54) PIPE FITTING STAND

(71) Applicant: MILWAUKEE ELECTRIC TOOL CORPORATION, Brookfield, WI (US)

(72) Inventors: Michael A. Verhagen, Milwaukee, WI (US); Caroline G. Fox, Milwaukee, WI (US); John S. Scott, Brookfield, WI (US); Scott T. Moeller, Richfield, WI (US); Amanda M. Kachar, West Allis, WI (US); Steven J. Berg, Jr., Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 142 days.

(21) Appl. No.: 17/374,195

(22) Filed: Jul. 13, 2021

(65) Prior Publication Data

US 2021/0339375 A1 Nov. 4, 2021

Related U.S. Application Data

(63) Continuation-in-part of application No. 16/286,852, filed on Feb. 27, 2019, now Pat. No. 11,090,781.

(60) Provisional application No. 62/715,426, filed on Aug. 7, 2018, provisional application No. 62/640,823, filed on Mar. 9, 2018.

(51) Int. Cl.
*B25H 1/04* (2006.01)

(52) U.S. Cl.
CPC ..... *B25H 1/04* (2013.01)

(58) Field of Classification Search
CPC ..... A47B 2003/025; A47B 2003/0821; A47B 3/02; A47B 3/0911; A47B 3/0918; A47B 3/08; B25H 1/00; B25H 1/0021; B25H 1/0042; B25H 1/02; B25H 1/04; B25H 1/16; B25B 1/20; B25B 1/205; B25B 1/2484; B25B 5/147; F16M 11/02; F16M 11/046

See application file for complete search history.

(56) References Cited

U.S. PATENT DOCUMENTS 960,916 A 6/1910 Heiser
1,252,423 A 1/1918 Friess
(Continued)

FOREIGN PATENT DOCUMENTS

CN 2106684 U 6/1992
CN 2810939 Y 8/2006
(Continued)

OTHER PUBLICATIONS

International Search Report and Written Opinion for Application No. PCT/US2022/035629 dated Oct. 21, 2022 (10 pages).
(Continued)

*Primary Examiner* — Tyrone V Hall, Jr.
(74) *Attorney, Agent, or Firm* — Michael Best & Friedrich LLP

(57) ABSTRACT

A pipe fitting stand for supporting a pipe during a work operation includes a table, and a plurality of legs coupled to the table. The plurality of legs are moveable between a first position and a second position via a linkage mechanism. The pipe fitting stand additionally includes a stirrup coupled to one of the plurality of the legs to facilitate pivoting the plurality of legs between the first position and the second position.

19 Claims, 15 Drawing Sheets

(56) References Cited

U.S. PATENT DOCUMENTS

| | | | | |
|---|---|---|---|---|
| 1,426,531 | A | 8/1922 | Albinson | |
| 1,686,023 | A | 10/1928 | McCloskey | |
| 1,695,311 | A | 12/1928 | Young | |
| 1,726,898 | A | 9/1929 | Jones | |
| 1,784,264 | A | 12/1930 | Young | |
| 1,798,340 | A | 3/1931 | Thewes | |
| 1,807,916 | A | 6/1931 | Jones | |
| 1,812,967 | A | 7/1931 | Long | |
| 1,820,592 | A * | 8/1931 | Bauer | A47B 3/0815 108/125 |
| 1,897,449 | A | 2/1933 | Trowbridge | |
| 2,110,718 | A | 3/1938 | Shiley | |
| 2,297,980 | A | 10/1942 | Perkins | |
| 2,343,924 | A | 3/1944 | Petersen | |
| 2,380,911 | A | 7/1945 | Petersen | |
| 2,619,858 | A | 12/1952 | Starbuck et al. | |
| 2,673,742 | A | 3/1954 | Vermette | |
| 2,678,790 | A | 5/1954 | Egger | |
| 2,709,384 | A | 5/1955 | Harris | |
| 2,831,583 | A | 4/1958 | Wright et al. | |
| 2,978,114 | A | 4/1961 | Halligan | |
| 2,989,142 | A | 6/1961 | Gill | |
| 2,991,490 | A | 7/1961 | Pirone | |
| 3,379,431 | A | 4/1968 | Gill | |
| 3,830,340 | A | 8/1974 | Schäffel | |
| 4,209,274 | A | 6/1980 | Martin et al. | |
| 4,671,478 | A | 6/1987 | Schoenig et al. | |
| 5,135,208 | A | 8/1992 | Diskin | |
| 6,073,919 | A | 6/2000 | Hammit et al. | |
| 6,412,764 | B1 | 7/2002 | Hebert | |
| 7,430,968 | B2 | 10/2008 | Clark | |
| 7,537,186 | B2 | 5/2009 | Putre et al. | |
| 7,690,408 | B2 | 4/2010 | Sugiura | |
| 7,992,852 | B2 | 8/2011 | Marineau et al. | |
| 8,276,895 | B2 | 10/2012 | Brown et al. | |
| 8,727,330 | B2 | 5/2014 | Hamm et al. | |
| 8,777,205 | B2 | 7/2014 | Hamm et al. | |
| 8,967,606 | B2 | 3/2015 | Hamm et al. | |
| 2002/0179181 | A1 | 12/2002 | Murphy | |
| 2006/0038093 | A1 * | 2/2006 | Putre | B25H 1/00 248/168 |
| 2008/0029662 | A1 | 2/2008 | O'Rourke | |
| 2009/0121405 | A1 | 5/2009 | Brown et al. | |
| 2010/0001450 | A1 * | 1/2010 | Marshall | B25H 1/16 269/266 |
| 2010/0107838 | A1 | 5/2010 | Berg et al. | |
| 2010/0164158 | A1 | 7/2010 | Weissenborn | |
| 2010/0269649 | A1 | 10/2010 | Rantz | |
| 2016/0195200 | A1 | 7/2016 | VanValkenburgh | |
| 2017/0129094 | A1 | 5/2017 | Hamm et al. | |
| 2019/0275643 | A1 | 9/2019 | Verhagen et al. | |
| 2021/0339375 | A1 | 11/2021 | Verhagen et al. | |

FOREIGN PATENT DOCUMENTS

| | | | |
|---|---|---|---|
| CN | 201205613 | Y | 3/2009 |
| CN | 201525012 | U | 7/2010 |
| CN | 201848777 | U | 6/2011 |
| CN | 202592233 | U | 12/2012 |
| CN | 103831746 | B | 6/2014 |
| CN | 107186676 | A | 9/2017 |
| DE | 304175 | A | 1/1917 |
| DE | 8019302 | U1 | 12/1980 |
| DE | 8708552 | U1 | 7/1987 |
| KR | 200230828 | Y1 | 7/2001 |
| KR | 1020110065198 | A | 6/2011 |
| WO | 8908011 | A1 | 9/1989 |

OTHER PUBLICATIONS

Extended European Search Report for Application No. 19764844.7 dated Oct. 26, 2021 (9 pages).

International Search Report and Written Opinion for Application No. PCT/US2019/019722 dated Jun. 14, 2019 (9 pages).

* cited by examiner

PIPE FITTING STAND

CROSS-REFERENCE TO RELATED APPLICATIONS

This application is a continuation-in-part of U.S. patent application Ser. No. 16/286,852 filed on Feb. 27, 2019, now U.S. Pat. No. 11,090,781, which claims priority to U.S. Provisional Patent Application No. 62/715,426 filed on Aug. 7, 2018 and U.S. Provisional Patent Application No. 62/640,823 filed on Mar. 9, 2018, the entire contents of all of which are incorporated herein by reference.

FIELD OF THE INVENTION

The present invention relates to workpiece supporting stands, and more particularly to pipe fitting stands.

BACKGROUND OF THE INVENTION

Pipe fitting stands are generally used to support a pipe during various operations such as threading, cutting, welding, etc. Pipe fitting stands typically include a table providing an upwardly directed work surface legs connected to the table.

SUMMARY OF THE INVENTION

The present invention provides, in one aspect, a pipe fitting stand for supporting a pipe during a work operation. The pipe fitting stand includes a table, a plurality of legs coupled to the table and moveable between a first position and a second position via a linkage mechanism, and a stirrup coupled to one of the plurality of the legs to facilitate pivoting the plurality of legs between the first position and the second position.

The present invention provides, in another aspect, a pipe fitting stand for supporting a pipe during a work operation. The pipe fitting stand includes a table, a plurality of legs coupled to the table and moveable between a deployed position and a stowed position, wherein a first leg of the plurality of legs is coupled to an underside of the table via a first bracket and a second leg of the plurality of legs is coupled to the underside of the table via a second bracket, and a reinforcing member coupling the first bracket to the second bracket.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
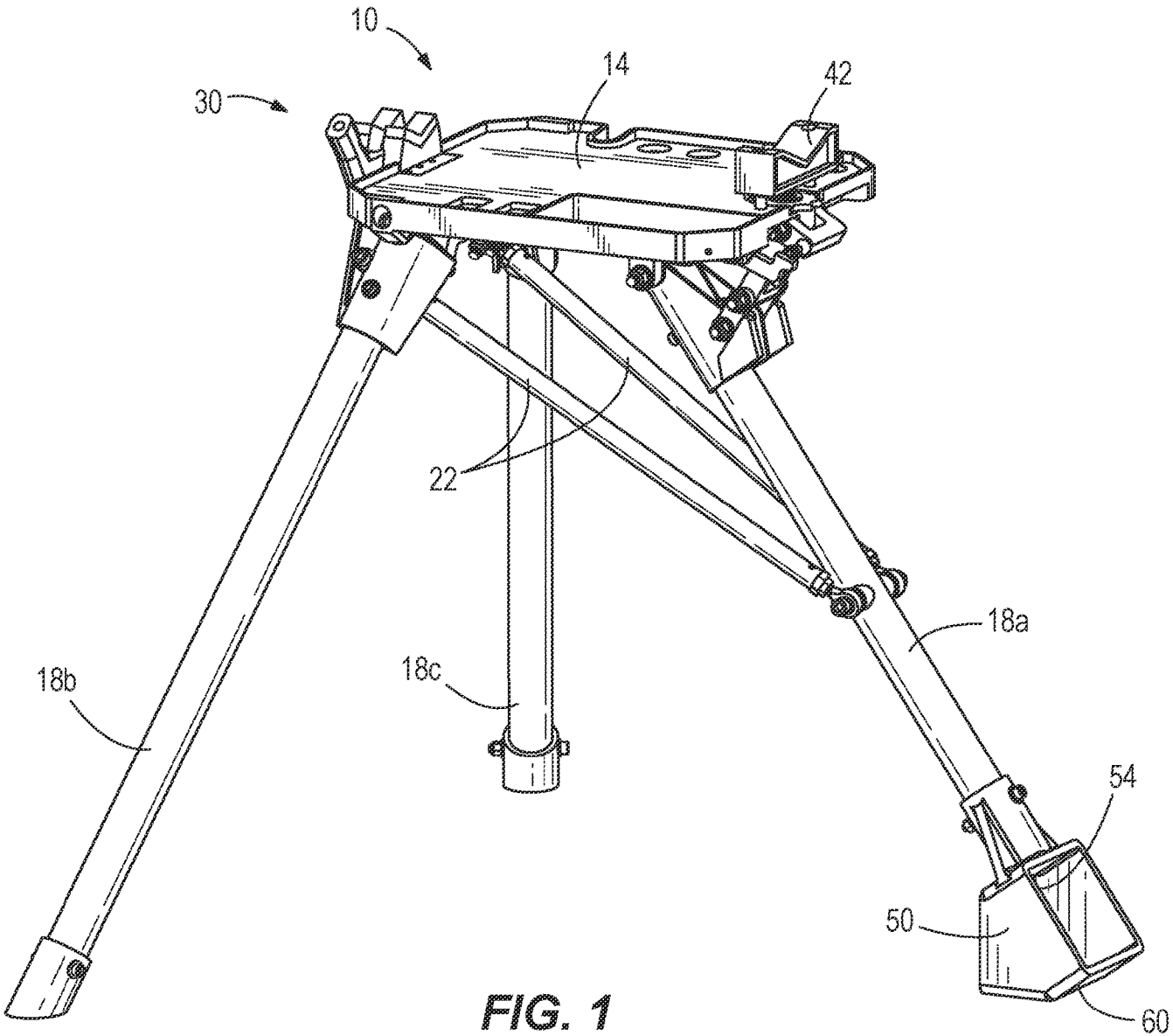
FIG. 1 is a perspective view of a pipe fitting stand in accordance with an embodiment of the invention.
Figure 4:
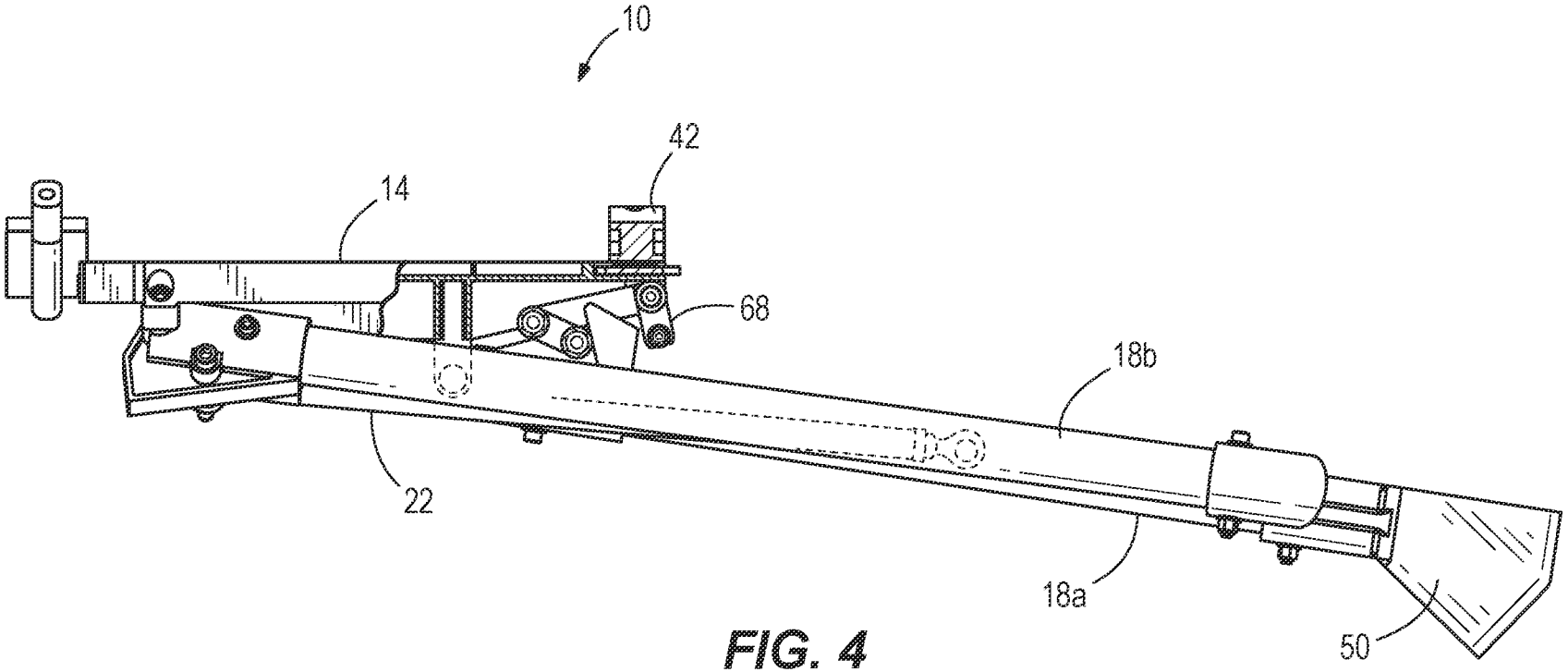
FIG. 4 is a side view of the pipe fitting stand of FIG. 1 in the folded state.
Figure 5:
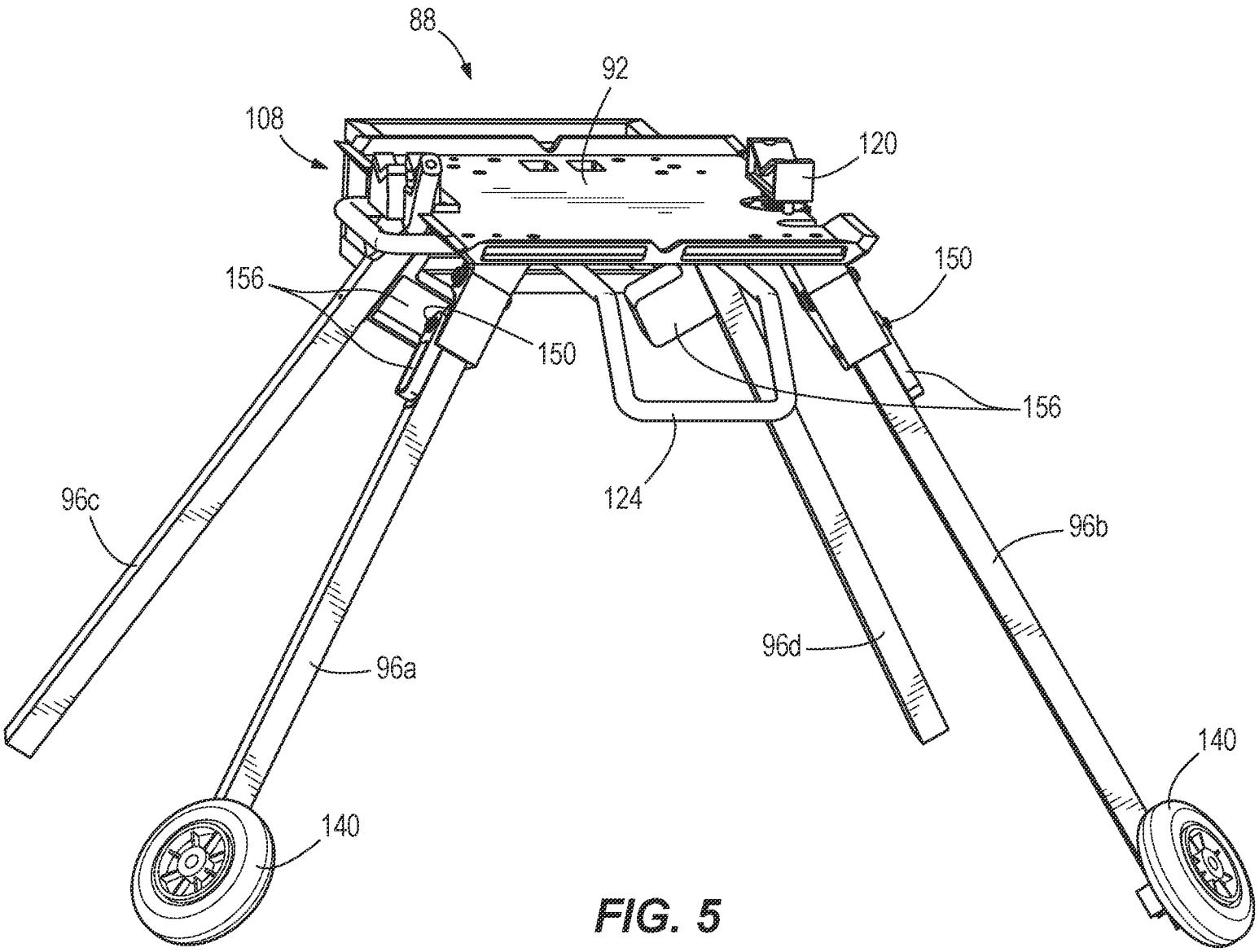
FIG. 5 is a perspective view of a pipe fitting stand in accordance with another embodiment of the invention.
Figure 6:
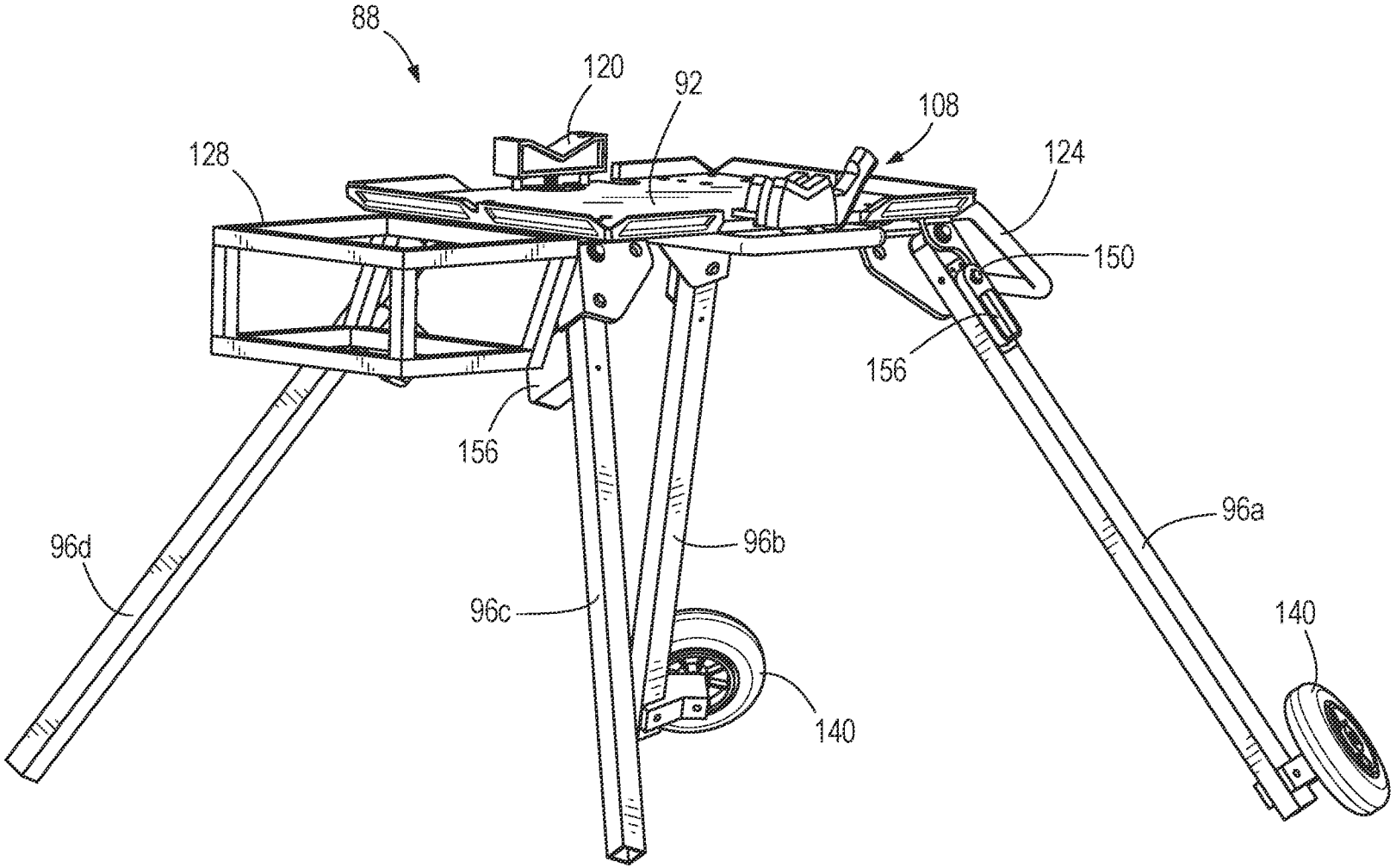
FIG. 6 is an alternative perspective view of the pipe fitting stand of FIG. 5.
Figure 7:
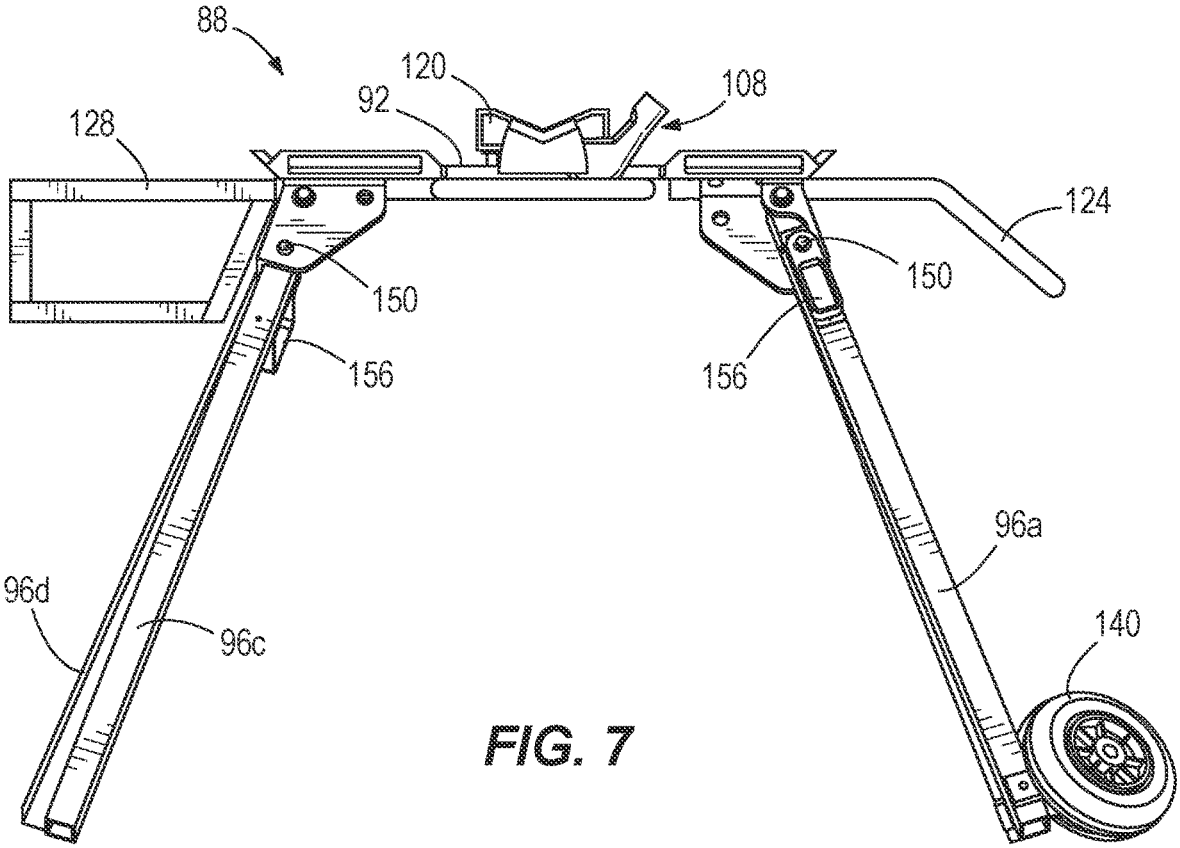
FIG. 7 is a side view of the pipe fitting stand of FIG. 5.
Figure 8:
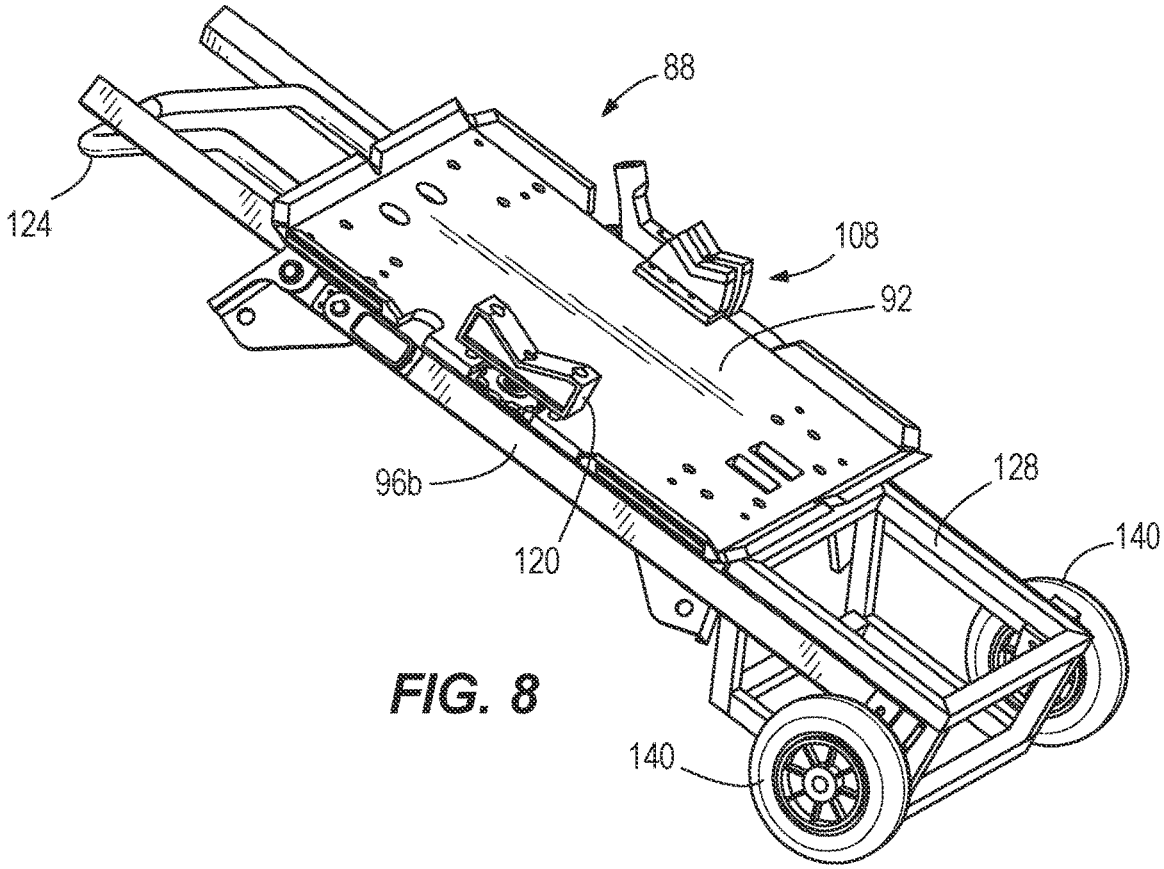
FIG. 8 is a perspective view of the pipe fitting stand of FIG. 5 in a folded state.
Figure 9:
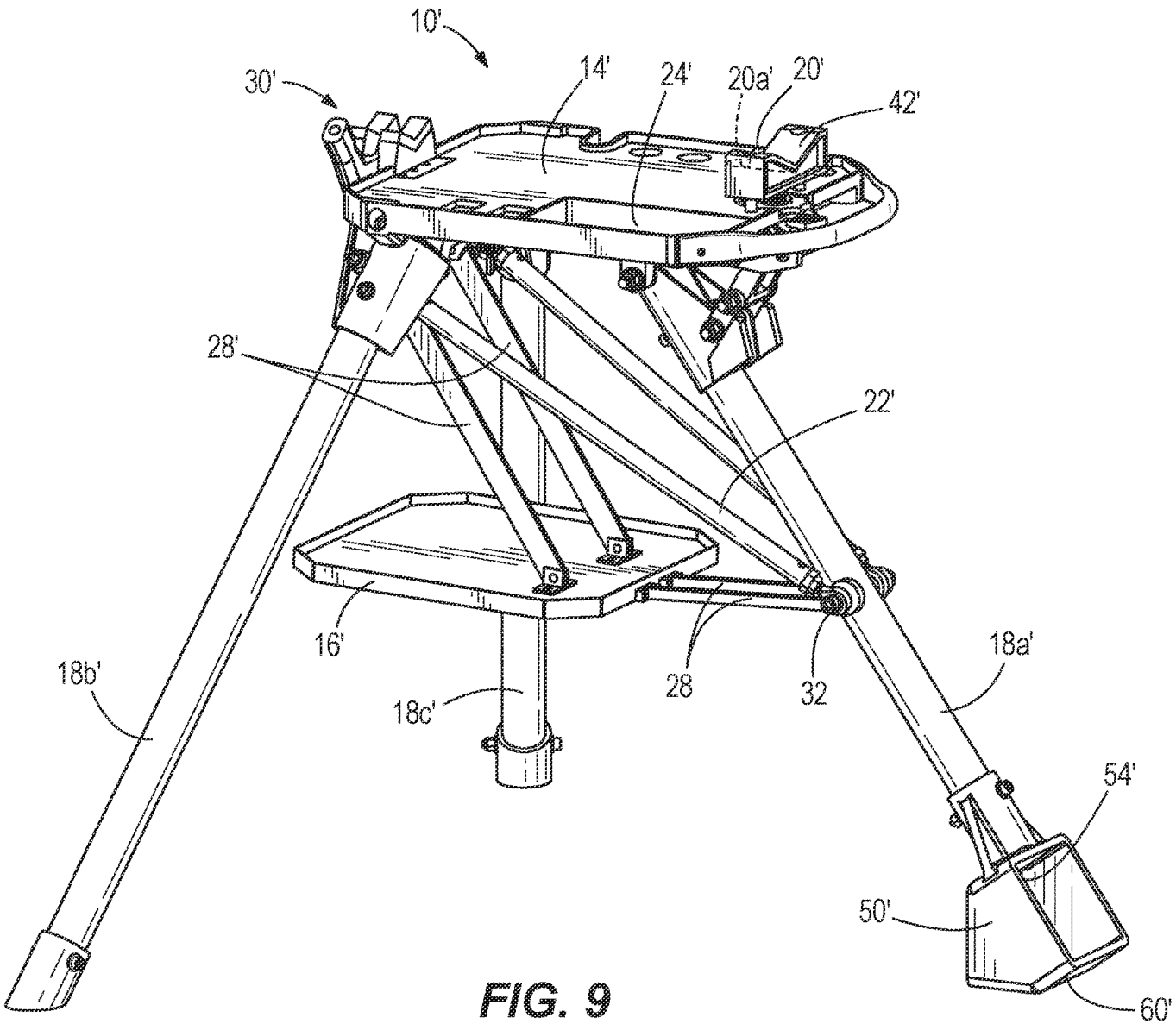
FIG. 9 is a perspective view of another pipe fitting stand in accordance with yet another embodiment of the invention, illustrating the pipe fitting stand in a deployed state.

FIG. 1 illustrates a pipe fitting stand 10 for supporting a pipe during a work operation. In the illustrated embodiment, the stand 10 includes a table 14 and three legs 18*a*-18*c* for supporting the table 14 in an elevated position with respect to a support surface. The stand 10 also includes two links 22 pivotably coupling a first of the legs 18*a*, respectively, with the other two legs 18*b*, 18*c* to coordinate movement of the legs 18*a*-18*c* as the stand 10 is reconfigured between a deployed state (shown in FIG. 1) and a folded state (FIG. 4).

With reference to FIG. 1, the table 14 includes a vise 30 at one end thereof for supporting and clamping a pipe to the table 14 and a support 42 located on a side of the table 14 opposite the vice 30 to additionally support the pipe. The support 42 is vertically adjustable relative to the table 14 (i.e., movable upward and downward) for adjusting the orientation of a pipe supported upon the support 42 and the vise 30.

Figure 1A:
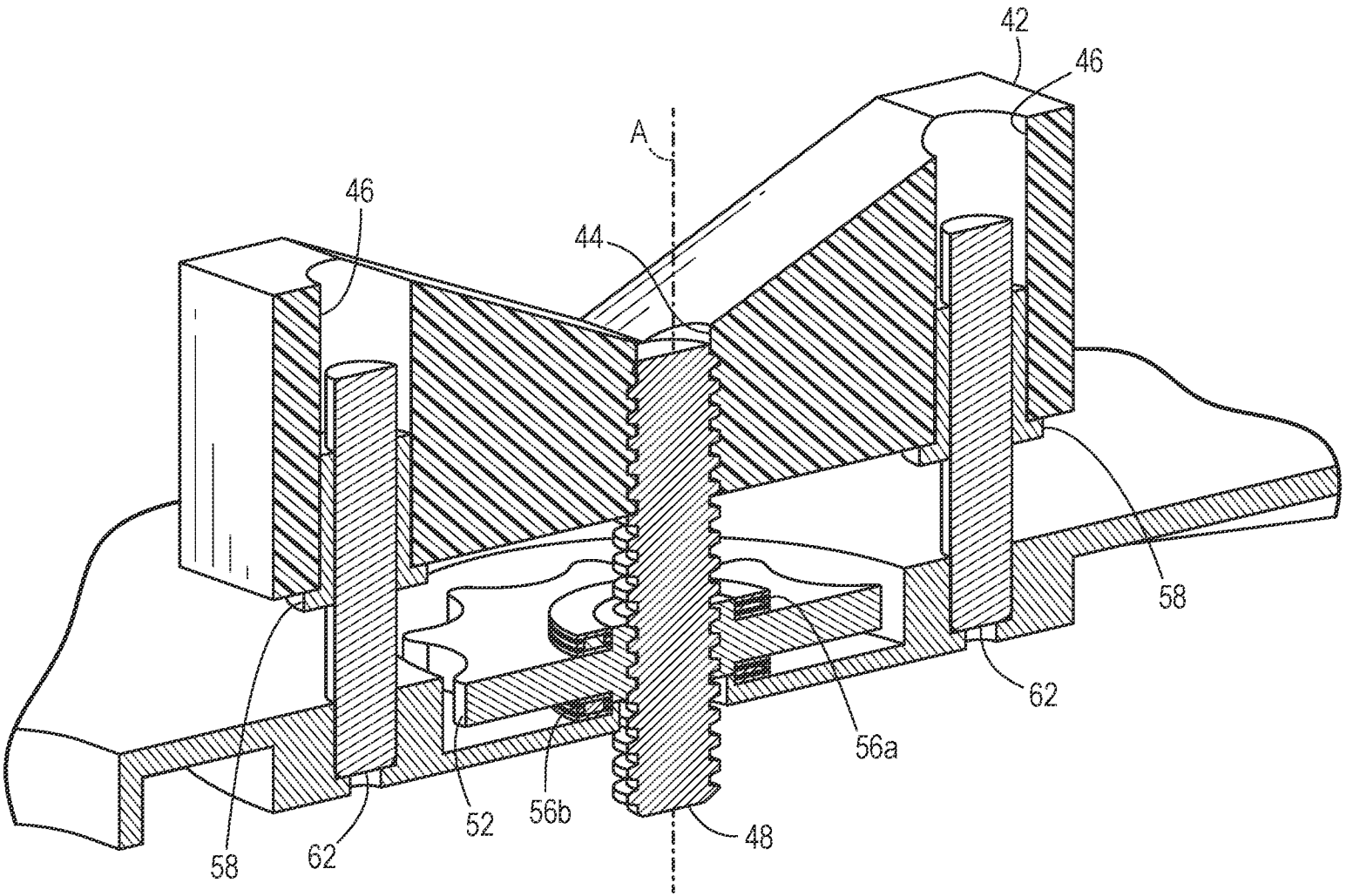
FIG. 1A is a perspective cross-sectional view of a portion of the pipe fitting stand of FIG. 1.

With reference to FIG. 1A, the support 42 includes a central aperture 44 extending along an axis A of the support 42, and two offset apertures 46 equidistantly disposed relative to the central aperture 44. A threaded rod 48 is affixed within the central aperture 44. The support 42 additionally includes a gear, or wheel 52, positioned between the table 14 and the support 42. The wheel 52 includes a threaded bore in which the rod 48 is received. An upper thrust bearing assembly 56*a* is positioned on an upper surface of the wheel 52, and a lower thrust bearing assembly 56*b* is positioned between a lower surface of the wheel 52 and the table 14. The offset apertures 46 include bushings 58 positioned within the apertures 46 to accept two cylindrical posts 62. The cylindrical posts 62 are anchored to the table 14 and are slidably received within the apertures 46 in order to prevent rotation of the support 42 relative to the table 14.

In order to move the support 42 relative to the table 14, the user may rotate the wheel 52 in a first direction (e.g., counterclockwise from the frame of reference of FIG. 1A). While rotating, the wheel 52 imparts translation to the threaded rod 48 in a downward direction, thus lowering the support 42 relative to the table 14. Likewise, rotation of the wheel 52 in an opposite direction imparts translation to the rod 48 in the opposite direction (e.g., upward), thus raising the support 42 relative to the table 14. The lower thrust bearing assembly 56*b* rotatably supports the wheel 52 on the table 14, while the upper thrust bearing assembly 56*a* reduces friction between the support 42 and the wheel 52 when the bottom surface of the support 42 contacts the bearing assembly 56*a* when the support 42 is in its lowermost position.

Each of the legs 18*a*-18*c* is separately pivotably coupled to the table 14. However, as mentioned above, the links 22 interconnect the legs 18*a*, 18*b* and the legs 18*a*, 18*c*, respectively, such that pivoting movement of the leg 18*a* relative to the table 14 causes the other legs 18*b*, 18*c* to also pivot relative to the table 14. The leg 18*a* includes a stirrup 50 having a bottom surface 60 that defines a ground-contacting surface of the leg 18*a* and an aperture 54 through which the foot of a user is receivable.

Figure 14:
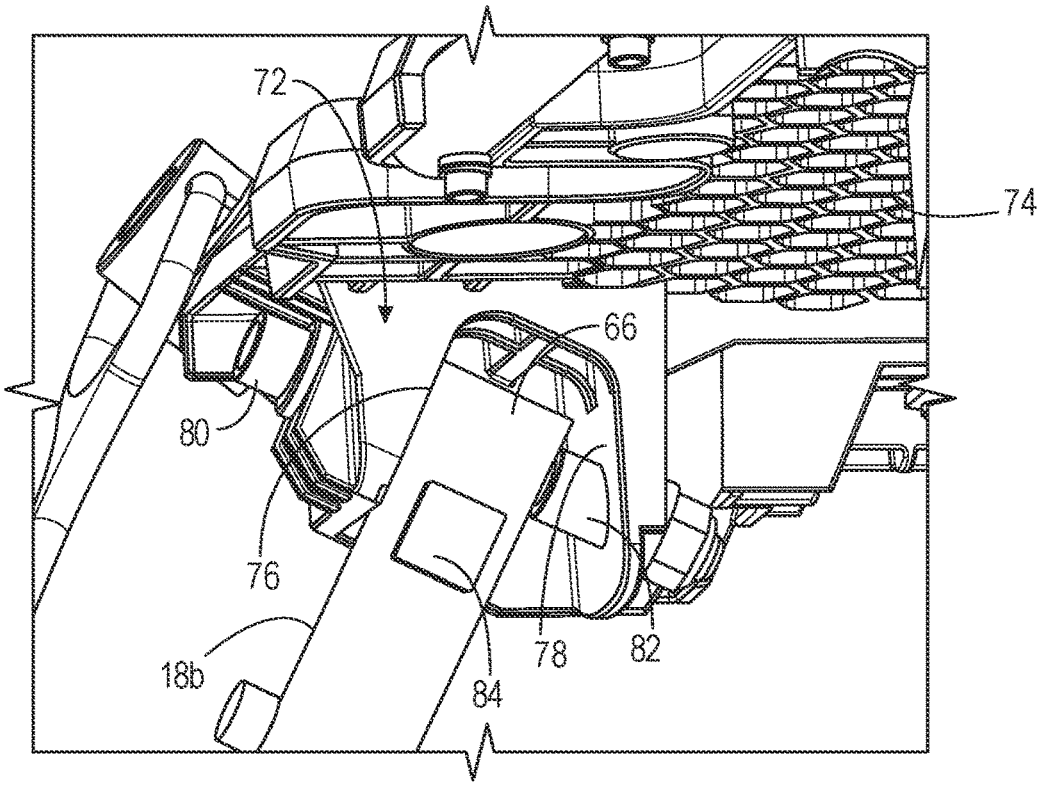
FIG. 14 is an enlarged perspective view of an underside of a table of the pipe fitting stand of FIG. 1.
Figure 15:
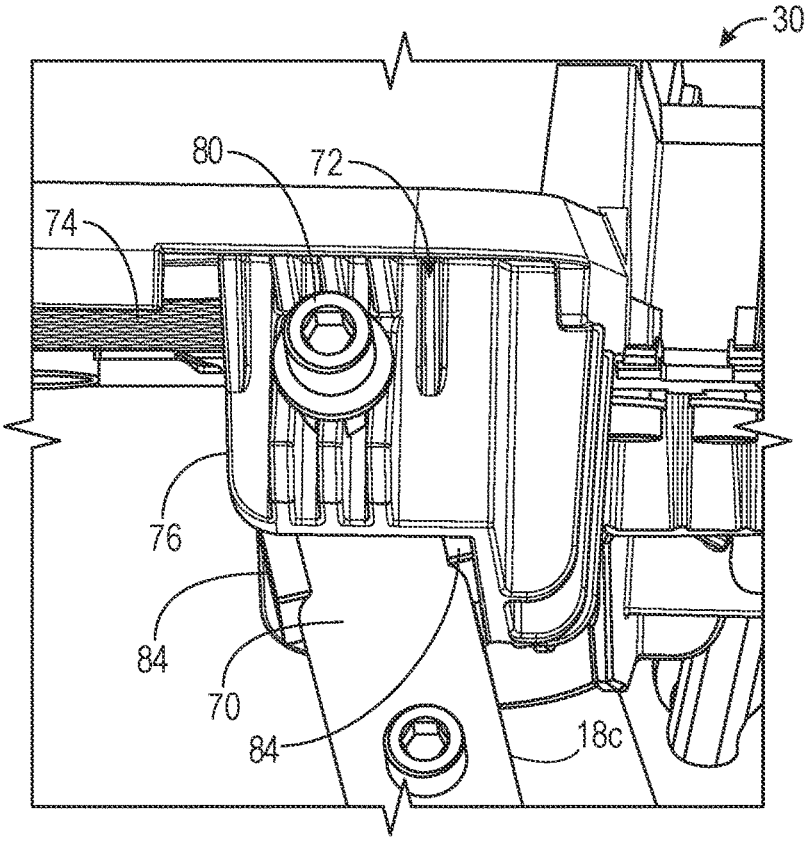
FIG. 15 is an enlarged perspective view of a side of the table of FIG. 1.

With reference to FIGS. 14-15, a distal end 66 of the second leg 18*b* and a distal end 70 of the third leg 18*c* are positioned within brackets 72 formed on an underside 74 of the table 14. Each of the brackets 72 includes a first, oblique or angled wall 76, and a second, vertical wall 78, opposing the first wall 76. A fastener 80 extends through the bracket 72 and the distal ends 66, 70 of the second and third legs 18*b*, 18*c*, coupling the legs 18*b*, 18*c* to the table 14. A spacer 82 is seated on the fastener 80, between the distal end 66, 70 of each of the legs 18*b*, 18*c* and the vertical wall 78, thereby urging the legs 18*b*, 18*c* toward the angled wall 76. Stops 84 are coupled (e.g., welded) to the distal ends 66, 70 of the legs 18*b*, 18*c*. The distal end 66, 70 of each of the legs 18*b*, 18*c* include one stop 84 positioned on opposing sides of the legs 18*b*, 18*c*, such that the stops 84 engage the bracket 72 when the table 14 is deployed. Engagement of the stops 84 against the table 14 precludes or eliminates any looseness between the legs 18*b*, 18*c* and the table 14, and prevents motion of the legs 18*b*, 18*c* past the deployed position.

Figure 16:
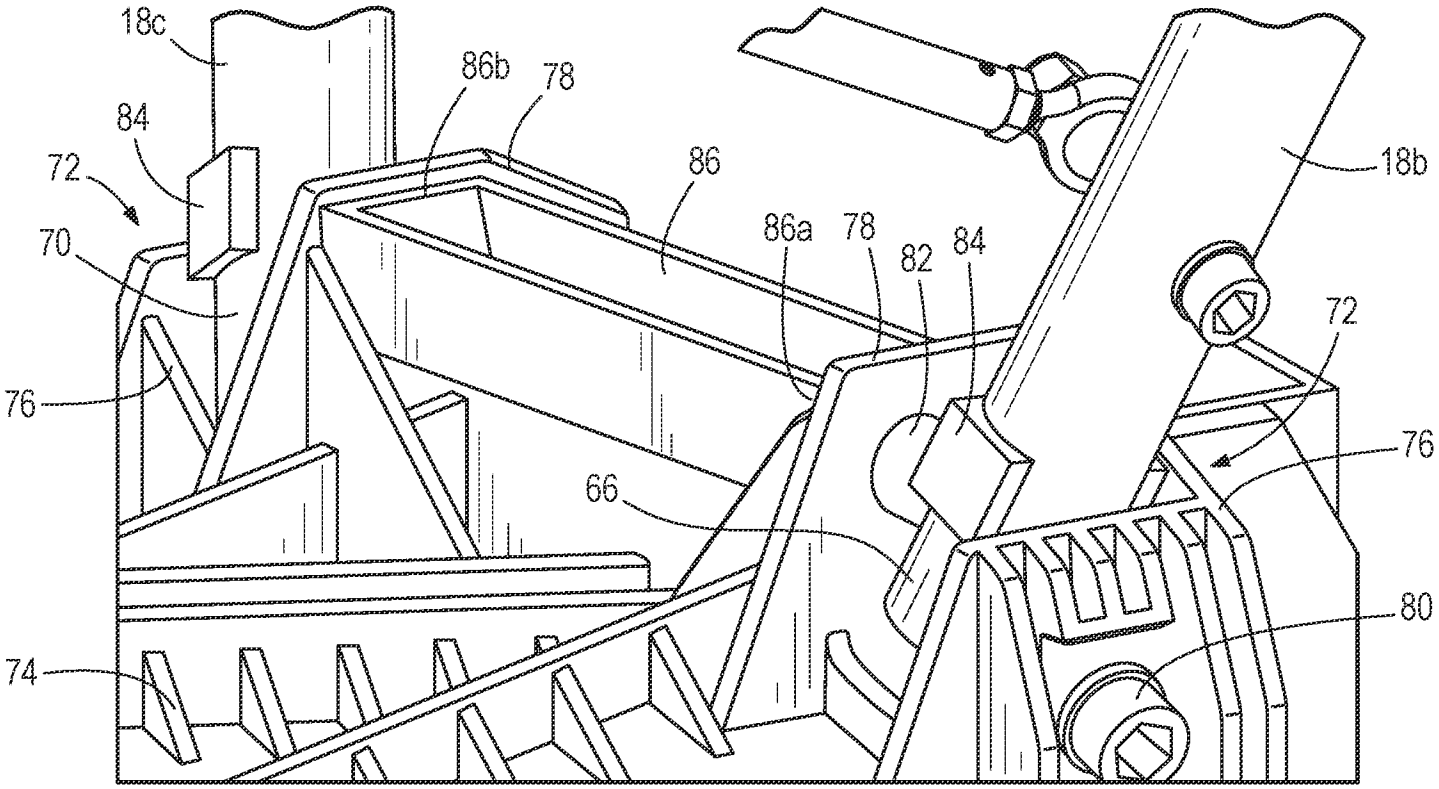
FIG. 16 is another enlarged perspective view of the underside of the table of FIG. 1.

With reference to FIG. 16, a reinforcing member, such as a tie-rod 86, is positioned between the brackets 72. More specifically, the tie-rod 86 is wedged between the vertical walls 78 of the brackets 72. The tie-rod 86 is generally trapezoidal and includes a first end 86*a* coupled to one of the vertical walls 78, and a second end 86*b* opposite the first end 86*a* coupled to the other of the vertical walls 78. In the illustrated embodiment, the tie-rod 86 is welded to the brackets 72. However, in alternative embodiments, the tie-rod 86 may be coupled to the bracket 72 in other ways (e.g., using fasteners, etc.). The tie-rod 86 is composed of a metal material (e.g., steel) and reinforces the table 14, which is made from die-cast Aluminum, in the region of the brackets 72. Positioning the tie-rod 86 between the brackets 72 of the second leg 18*b* and the third leg 18*c* increases the strength and stability of the stand 10.

The stand 10 also includes a locking mechanism 64 extending between the table 14 and the leg 18*a* for selectively locking the leg 18*a* into a deployed position (shown in FIG. 1). Because the other legs 18*b*, 18*c* are connected to the leg 18*a* via the links 22, the legs 18*b*, 18*c* are also locked into a deployed position when the leg 18*a* is locked into the deployed position by the locking mechanism 64. The locking mechanism 64 includes a latch 68, which is manipulated by the user to alternately lock and release the locking mechanism 64.

Figure 2:
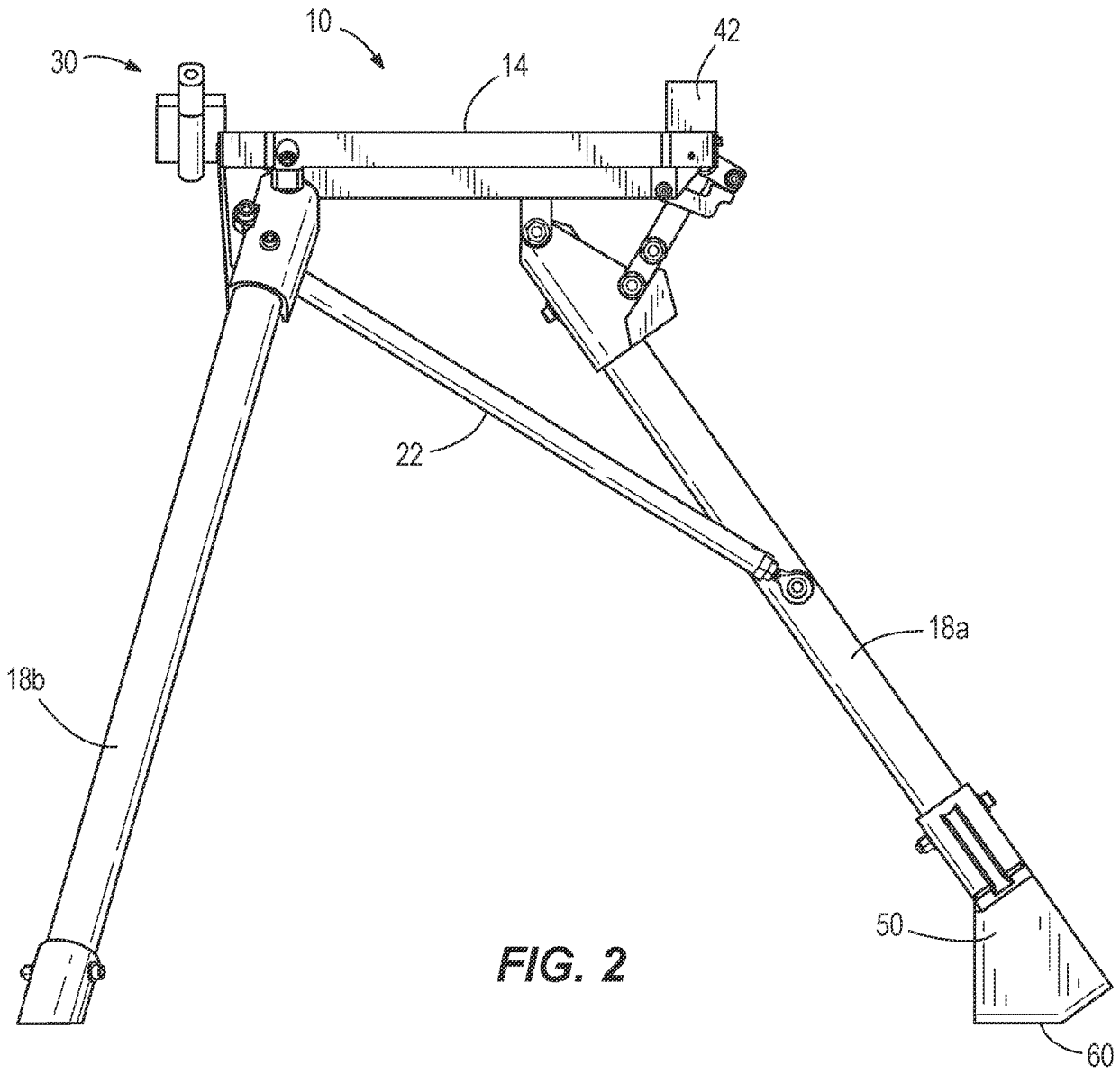
FIG. 2 is a side view of the pipe fitting stand of FIG. 1.
Figure 3:
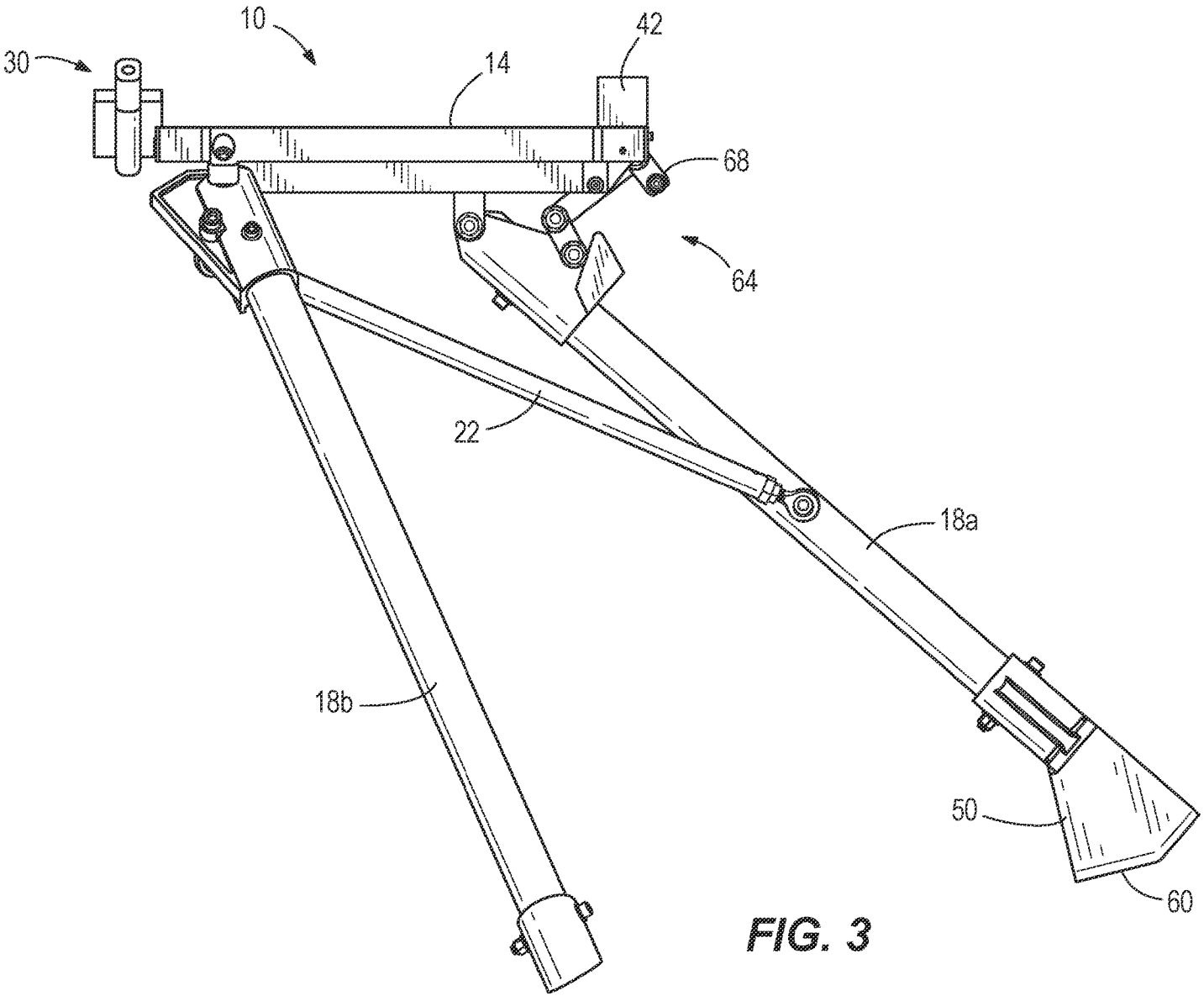
FIG. 3 is a side view of the pipe fitting stand of FIG. 1 transitioning from a deployed state toward a folded state.

To fold the stand 10 from the deployed state (FIGS. 1 and 2) to a folded state (FIG. 4), a user releases the latch 68 while maintaining pressure on the stirrup 50 (with the user's foot extending through the aperture 54) in order to keep the bottom surface 60 of the stirrup 50 in contact with the ground. The user then lifts the side of the table 14 opposite the leg 18*a*, subsequently causing the table 14 to pivot relative to the leg 18*a*. At the same time, the remaining legs 18*b*, 18*c* are lifted from the ground and are pivoted relative to the table 14 by the links 22 (FIG. 3). When the stand 10 is in the fully folded state shown in FIG. 4, the legs 18*b*, 18*c* are positioned side by side with the leg 18*a*, with the leg 18*a* between the other two legs 18*b*, 18*c*. The user can then easily store and transport the stand 10. The stand 10 can be reconfigured from the folded state to the deployed state using a reverse procedure.

FIG. 5-8 illustrate an alternative embodiment of a pipe fitting stand 88. The stand 88 includes a table 92 and four legs 96*a*-96*d* for supporting the table 92 in an elevated position with respect to a support surface. Each of the legs 96*a*-96*d* is separately pivotably coupled to the table 92, and the stand 10 further includes a separate locking mechanism associated with each of the legs 96*a*-96*d*. In the illustrated stand 88, the locking mechanism includes a pin detent 150 carried by the respective legs 96*a*-96*d* and a handle 156 for actuating the pin detent 150 between a locked position in which the associated leg 96*a*-96*d* is maintained in either a deployed position or a folded position, and a released position, in which the associated leg 96*a*-96*d* is movable between the deployed and folded positions. Two of the legs 96*a*, 96*b* include wheels 140 to facilitate transport of the stand 88.

The table 92 includes a vise 108 at one end thereof for supporting and clamping a pipe to the table 92 and a support 120 located on a side of the table 92 opposite the vise 108 to additionally support the pipe. In one embodiment of the stand 88, the support 120 is vertically adjustable relative to the table 92 (i.e., movable upward and downward) for adjusting the orientation of a pipe supported upon the support 120 and the vise 108.

An operating handle 124 extends from a side of the table 92 proximate the legs 96*a*, 96*b* fora user to grasp during transport and/or operation of the stand 88. A storage compartment 128 (FIG. 8) extends from an opposite side of the table 92 to provide storage for tools and other items during transport and/or operation of the stand 88.

The legs 96*a*-96*d* fold inwardly such that the non-wheeled legs 96*c*, 96*d* fold towards the wheeled legs 96*a*, 96*b*, and the wheeled legs 96*a*, 96*b* fold towards the non-wheeled legs 96*c*, 96*d*. When in the folded positon shown in FIG. 8, the wheeled legs 96*a*, 96*b* are positioned alongside the storage compartment 128, and the non-wheeled legs 96*c*, 96*d* are positioned alongside the handle 124. Consequently, the wheels 140 are positioned on opposite sides of the storage compartment 128, and on an opposite side of the table 92 as the handle 124. The user then tilts the stand 88 in such a way that the operating handle 124 is held in an inclined orientation with the wheels 140 contacting the ground, allowing a user to easily transport the stand 88.

FIGS. 9-13 illustrate another alternative embodiment of a pipe fitting stand 10', with like parts as the pipe fitting stand 10 of FIGS. 1-4 being shown with like reference numerals plus a prime marker (').

Figure 13:
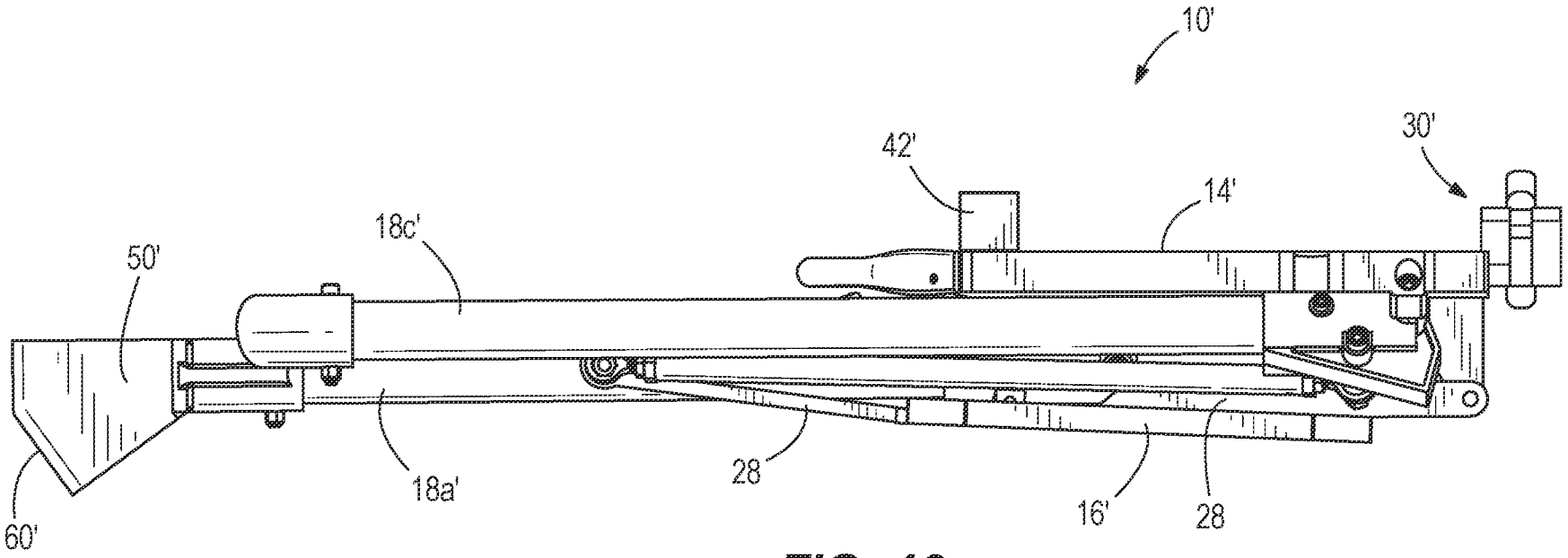
FIG. 13 is a side view of the pipe fitting stand of FIG. 9 in a folded state.

The illustrated pipe fitting stand 10' includes a table 14' and three legs 18*a*'-18*c*' for supporting the table 14' in an elevated position with respect to a support surface. The stand 10' also includes two links 22' pivotably coupling a first of the legs 18*a*', respectively, with the other two legs 18*b*', 18*c*' to coordinate movement of the legs 18*a*'-18*c*' as the stand 10' is reconfigured between a deployed state (FIGS. 9-11) and a folded state (FIG. 13). The table 14' includes a vise 30' at one end thereof for supporting and clamping a pipe to the table 14' and a support 42' located on a side of the table 14' opposite the vice 30' to additionally support the pipe. The support 42' is vertically adjustable relative to the table 14' (i.e., movable upward and downward) for adjusting the orientation of the pipe on the stand 10'. In some embodiments, the vice 30' may include a chain for securing the pipe in place while positioned on the table 14'. The vice 30' may additionally include a storage portion (not shown) for storing the chain during storage or carrying of the pipe stand 10'.

Figure 10:
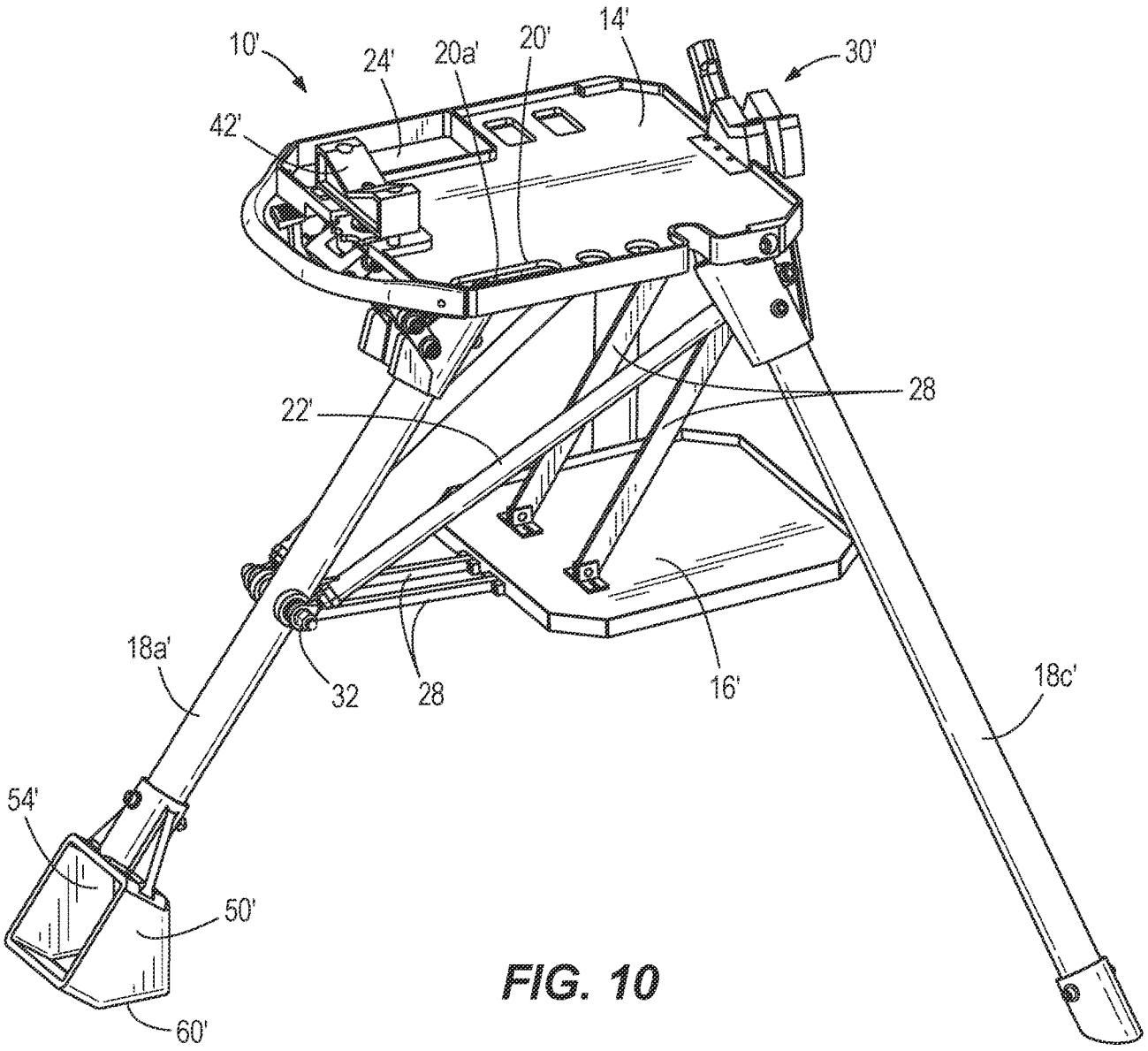
FIG. 10 is a reverse perspective view of the pipe fitting stand of FIG. 9.
Figure 11:
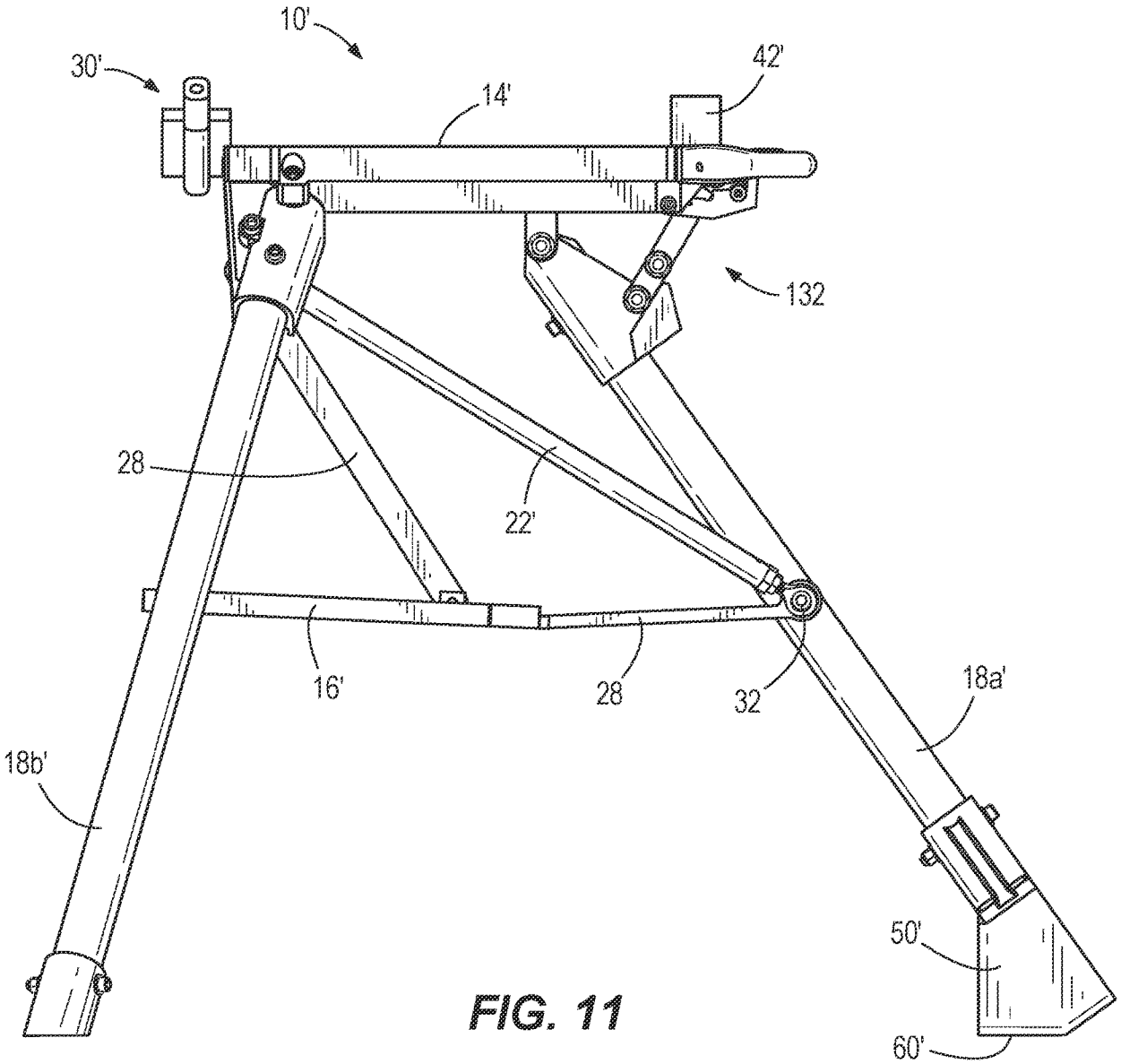
FIG. 11 is a side view of the pipe fitting stand of FIG. 9.

The table 14' additionally includes a carrying handle 20' positioned on a side of the table 14' (FIG. 10). A user may grasp the carrying handle 20' for additional support when using or transporting the pipe stand 10'. Furthermore, the user may temporarily store tools within an aperture 20*a*' formed in the table 14' that at least partially defines the carrying handle 20'. Substantially opposite the carrying handle 20', the table 14' includes a storage portion 24'. The storage portion 24' is recessed within the table 14' such that the storage portion 24' may receive small items (e.g., writing utensils, small tools) while a user is using the stand 10'.

For additional storage, the stand 10' also includes a shelf 16' positioned beneath the table 14'. The shelf 16' is pivotably coupled to the legs 18*b*', 18*c*' through respective linkages 28 coupled to the underside of the table 14'. Additionally, the shelf 16' is pivotably coupled to the leg 18*a*' by parallel linkages 28 extending from an edge of the shelf 16' for connection to the same pivot shaft 32 to which the linkages 22' are pivotably coupled to the leg 18*a*'. When the legs 18*a*'-18*c*' pivot relative to the table 14' into the folded position, the linkages 28, 29 pivot the shelf 16' upward and towards the underside of the table 14', such that the shelf 16' and the legs 18*a*'-18*c*' are substantially parallel to the table 14' (FIG. 13). The leg 18*a*' further includes a stirrup 50' having a bottom surface 60' that defines a ground-contacting surface of the leg 18*a*' and an aperture 54' through which the foot of a user is receivable.

Figure 12:
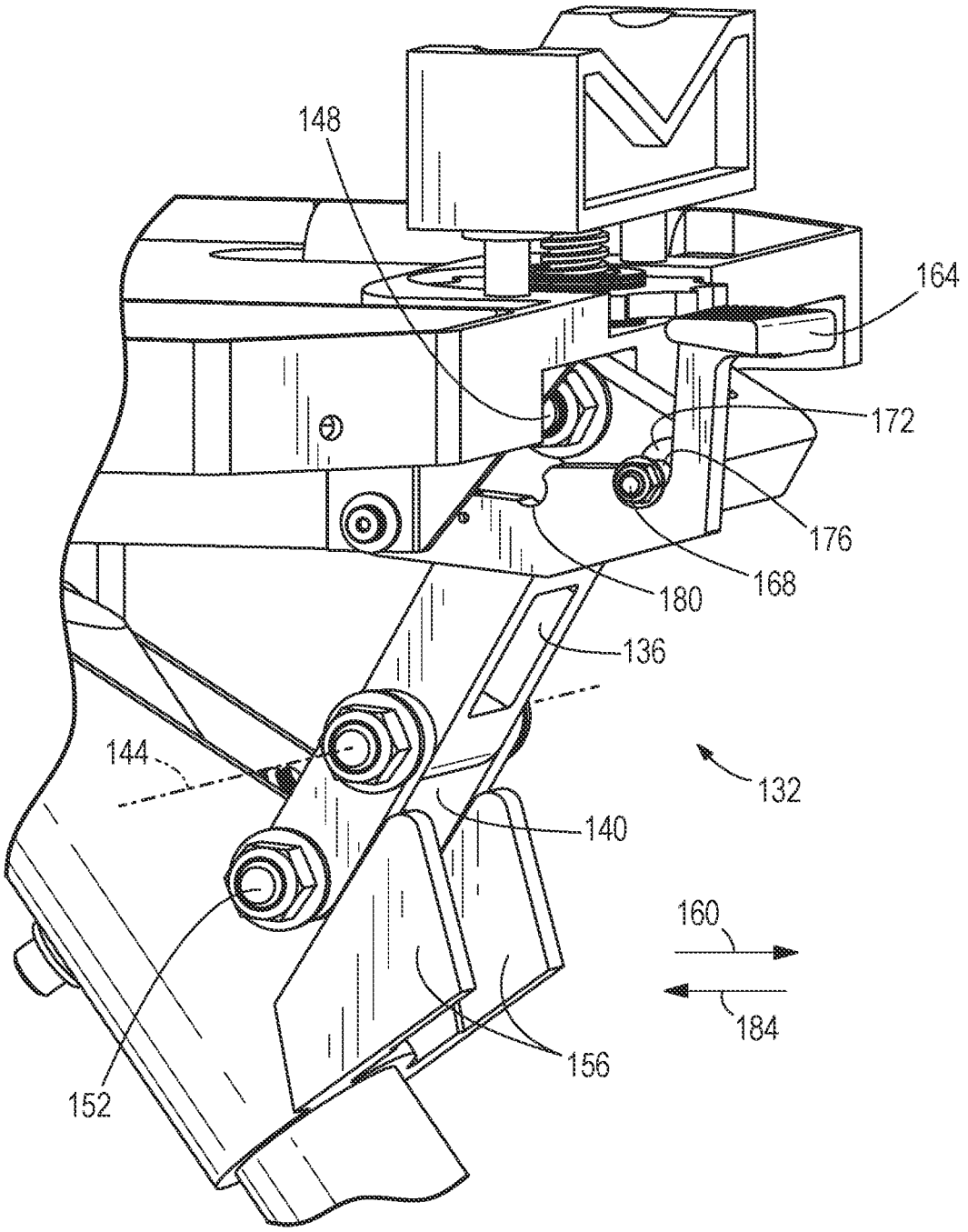
FIG. 12 is an enlarged view of a portion of the pipe fitting stand of FIG. 11, illustrating a latch mechanism for securing the stand in each of the deployed state and the folded state.

In order to lock the stand 10' in the folded position, the table 14' includes a locking mechanism 132 (FIG. 12). The locking mechanism 132 includes a first link 136 pivotably coupled to a second link 140 about an axis 144. The first link 136 is pivotably coupled to the underside of the table 14' via a first fastener 148 (e.g., bolt, screw, etc.), which extends through the link 136 and a portion of the table 14'. The second link 140 is pivotably coupled to the leg 18*a*' via a fastener 152 (e.g., bolt, screw, etc.). The second link 140 additionally extends parallel to flanges 156 of the leg 18*a*', which may contact the link 140 and prevent the link 140 from pivoting further than the flanges 156 in a first direction 160.

The locking mechanism 132 also includes a latch 164 pivotably coupled to the underside of the table 14'. The latch 164 is adjacent the first link 136 and engageable with the first link 136 to prevent pivoting movement of the first link 136, and thus, pivoting movement of the second link 140 and the leg 18*a*'. Because the leg 18*a*' is pivotably coupled to the other legs 18*b*', 18*c*' by the respective links 22', all of the legs 18*a*'-18*c*' are locked in either a deployed position or a folded position when the latch 164 locks the leg 18*a*' in its deployed or folded positions, respectively. Specifically, the first link 136 includes a fastener 168 (e.g., bolt, screw, etc.) securing a striker 172 to the first link 136. The striker 172 is engageable and received within a first arcuate groove 176 in the latch 164 to secure the legs 18*a*'-18*c*' in their deployed positions. The latch 164 further includes a second arcuate groove 180 for receiving the striker 172 when the legs 18*a*'-18*c*' are pivoted into their folded positions to thereby lock the legs 18*a*'-18*c*' in their folded positions.

When a user wants to retract the legs 18*a*'-18*c*' into the folded position, the user depresses the latch 164. The latch 164 therefore moves downward, disengaging the striker 172 from the first arcuate groove 176. Due to the position of the flanges 156, the second link 140 is only capable of pivoting in a second direction 184, which causes the first link 136 to pivot about the pivot axis 144 and also pivot in the second direction 184. As the links 136, 140 pivot, the legs 18*a*'-18*c*' fold upwards towards the table 14'. If the latch 164 is released during this time, the striker 172 slides along an edge of the latch 164 extending between the grooves 168, 180, and then falls into the second arcuate groove 180 to lock the legs 18*a*'-18*c*' in their folded positions.

Various features of the invention are set forth in the following claims.

What is claimed is:

1. A pipe fitting stand for supporting a pipe during a work operation, the pipe fitting stand comprising:

a table;

a plurality of legs coupled to the table and moveable between a first position and a second position via a linkage mechanism; and a stirrup coupled to one of the plurality of the legs to facilitate pivoting the plurality of legs between the first position and the second position.

2. The pipe fitting stand of claim 1, wherein the stirrup includes a bottom surface for contacting the ground and an aperture through which the foot of a user is receivable.

3. The pipe fitting stand of claim 2, wherein downward pressure on the stirrup by a user's foot when inserted through the aperture maintains the bottom surface of the stirrup on the ground while pivoting the table, allowing the plurality of legs to move from the first position to the second position.

4. The pipe fitting stand of claim 1, further comprising a locking mechanism configured to selectively lock at least one of the legs relative to the table.

5. The pipe fitting stand of claim 4, wherein the locking mechanism includes a pin detent positioned on each of the legs and a handle configured to actuate the pin detent between a locking position, in which the legs are locked in the first position or the second position, and a released position, in which each of the legs is moveable between the first position and the second position.

6. The pipe fitting stand of claim 4, wherein the linkage mechanism comprises a first link interconnecting a first of the plurality of legs and a second of the plurality of legs, and a second link interconnecting the first leg and a third of the plurality of legs, wherein the locking mechanism extends between the table and the first leg to selectively lock the first leg, and the second and third legs via the first and second links, in the first position, and wherein the locking mechanism includes a latch configured to lock and release the locking mechanism.

7. The pipe fitting stand of claim 1, further comprising:

a vise coupled to the table for supporting a first portion of the pipe; and a support positioned on a side of the table opposite the vise upon which a second portion of the pipe is supporting.

8. The pipe fitting stand of claim 7, wherein the support is vertically adjustable relative to the table, thereby adjusting the orientation of the pipe relative to the table.

9. The pipe fitting stand of claim 1, further comprising a wheel coupled to at least two of the legs to facilitate transport of the stand when the legs are pivoted to at least one of the first position or the second position.

10. The pipe fitting stand of claim 1, further comprising a shelf coupled to the legs via the linkage mechanism, wherein the shelf is moveable to a position that is substantially parallel with the table when the legs are pivoted from the first position to the second position.

11. A pipe fitting stand for supporting a pipe during a work operation, the pipe fitting stand comprising:

a table;

a plurality of legs coupled to the table and moveable between a deployed position and a stowed position, wherein a first leg of the plurality of legs is coupled to an underside of the table via a first bracket and a second leg of the plurality of legs is coupled to the underside of the table via a second bracket; and a reinforcing member coupling the first bracket to the second bracket, wherein each of the first bracket and the second bracket includes a first wall and a second wall, further comprising a first spacer positioned between the second wall of the first bracket and the first leg, and a second spacer positioned between the second wall of the second bracket and the second leg, wherein the first spacer and the second spacer urges the first leg and the second leg toward the first wall of the first bracket and the first wall of the second bracket, respectively.

12. The pipe fitting stand of claim 11, wherein the first wall each of the first bracket and the second bracket is an angled wall, wherein the second wall of each of the first bracket and the second bracket is a vertical wall, and wherein the vertical wall is opposing the angled wall.

13. The pipe fitting stand of claim 12, wherein the reinforcing member is coupled to the vertical walls of the first bracket and the second bracket, respectively.

14. The pipe fitting stand of claim 12, wherein a distal end of the first leg and the second leg, respectively, are positioned between the angled wall and the vertical wall of the first bracket and the second bracket, respectively.

15. The pipe fitting stand of claim 12, further comprising a first fastener extending through the first bracket and the first leg, and a second fastener extending through the second bracket and the second leg, thereby coupling the first leg and the second leg to the table.

16. The pipe fitting stand of claim 11, wherein the reinforcing member is welded to the first bracket and the second bracket.

17. The pipe fitting stand of claim 11, further comprising a first stop positioned on the first leg and a second stop positioned on the second leg, wherein the first stop and the second stop are configured to engage the first bracket and the second bracket, respectively, when the first and second legs are in the deployed position.

18. The pipe fitting stand of claim 11, wherein plurality of legs are coupled to the table and moveable between a first position and a second position via a linkage mechanism.

19. The pipe fitting stand of claim 18, wherein the linkage mechanism includes a first link interconnecting the first leg and a third leg of the plurality of legs, and a second link interconnecting the second leg and the third leg.

* * * * *